US011608980B2

(12) United States Patent
Pasteris et al.

(10) Patent No.: US 11,608,980 B2
(45) Date of Patent: Mar. 21, 2023

(54) REUSABLE CANDLE VESSEL

(71) Applicants: Lindsay Raquel Pasteris, Aventura, FL (US); Nathan Steven Donovan, Aventura, FL (US)

(72) Inventors: Lindsay Raquel Pasteris, Aventura, FL (US); Nathan Steven Donovan, Aventura, FL (US)

( * ) Notice: Subject to any disclaimer, the term of this patent is extended or adjusted under 35 U.S.C. 154(b) by 0 days.

(21) Appl. No.: 17/707,093

(22) Filed: Mar. 29, 2022

(65) Prior Publication Data

US 2022/0316695 A1 Oct. 6, 2022

Related U.S. Application Data

(60) Provisional application No. 63/282,759, filed on Nov. 24, 2021, provisional application No. 63/168,108, filed on Mar. 30, 2021.

(51) Int. Cl.
*F21V 35/00* (2006.01)

(52) U.S. Cl.
CPC ..... *F21V 35/003* (2013.01)

(58) Field of Classification Search
CPC .. F21V 35/003; F21V 35/00; B65D 77/00493
USPC ..... 431/288–289, 291; 221/260, 307
See application file for complete search history.

(56) References Cited

U.S. PATENT DOCUMENTS 6,375,455 B2 4/2002 Frandsen et al.
6,428,310 B1 * 8/2002 Nicholas G. ..... C11C 5/023 249/94
6,435,694 B1 8/2002 Bell et al.
6,638,060 B1 10/2003 Rivard et al.
7,044,320 B2 5/2006 Mladenovic
8,529,974 B2 * 9/2013 Ortiz ..... B65D 77/0493 426/115
9,228,737 B2 1/2016 Steinmann et al.
2015/0086932 A1 3/2015 Rutan
2022/0228740 A1 7/2022 Caldwell, Jr.
2022/0390100 A1 12/2022 Miyagi

FOREIGN PATENT DOCUMENTS

DE 102008061313 A1 6/2010
EP 2752619 A2 2/2019
KR 20070013523 A 1/2007

OTHER PUBLICATIONS

International Search Report and Written Opinion dated Aug. 8, 2022 in corresponding International Application No. PCT/US2022/022295.

* cited by examiner

*Primary Examiner* — Vivek K Shirsat
(74) *Attorney, Agent, or Firm* — Renner, Otto, Boisselle & Sklar, LLP

(57) ABSTRACT

A candle or candle vessel in which the vessel includes an upper portion and a lower portion. At least a portion of the lower portion of the candle vessel is displaceable relative to the upper portion to allow a meltable solid to be easily removed from the candle vessel. The lower portion may include a flexible, non-adhesive, and heat-resistant interior part which lines the lower portion that is in contact with the meltable solid. An exterior of the vessel may be wrapped in a sturdy, durable shell for additional design and structure of the candle vessel.

22 Claims, 10 Drawing Sheets

REUSABLE CANDLE VESSEL

RELATED APPLICATIONS

This application claims the benefit of U.S. Application No. 63/168,108 filed Mar. 30, 2021 and U.S. Application No. 63/282,759 filed Nov. 24, 2021, each of which is hereby incorporated herein by reference in its entirety.

TECHNICAL FIELD

The present invention relates to candles or candle vessels. More particularly, the invention relates to a refillable/reusable candle vessel such as for reducing environmental waste.

BACKGROUND

There are many candles thrown away on a daily basis, which can have a detrimental effect on the environment. For example, many candles today use toxic, paraffin-based waxes. In addition, many of the jars that contain the candle wax are made of non-biodegradable materials such as glass, tin, ceramic, or the like, and are not designed to be reused by consumers. As a result, these non-biodegradable single-use candle jars containing remnant toxic wax will sit in landfills for years.

SUMMARY

Conventional candles of the type described above are relatively expensive and generally require the consumers who purchase the candles to continually repurchase an entire new candle jar with wax every time. This is because regular candle vessels do not allow for easy removal of leftover wax once the candle has been melted down. In addition, only certain jars are durable enough to be reused multiple times. As a result, conventional candles typically are made to be thrown out, thus having a detrimental impact on the environment.

An aspect of the present disclosure provides a solution to one or more problems associated with conventional candles by providing a candle vessel with a flexible portion that allows for the easy removal of leftover resolidified melt and reusability of the vessel by a user.

According to an aspect, a candle holder includes a body in which at least a portion of the body is made of a flexible material that permits displacement and removal of remnant resolidified melt.

According to an aspect, a candle or candle vessel includes an upper portion and a lower portion. At least a portion of the lower portion of the candle vessel is displaceable relative to the upper portion to allow a meltable solid to be easily removed from the candle vessel. The lower portion may include a flexible, resilient, non-adhesive, and heat-resistant interior part which lines at least a portion of the bottom, and preferably, the entire interior of the vessel. In exemplary embodiment(s), the vessel is wrapped in a sturdy, durable shell for additional design and structure.

According to an aspect, the present disclosure provides a refillable candle including: a vessel body having an internal cavity; a meltable solid disposed in the internal cavity; and a burnable wick disposed in the meltable solid; wherein the vessel body includes: an upper portion that forms at least a portion of one or more sidewalls of the internal cavity, the upper portion having at least one opening for accessing the internal cavity, and a lower portion that forms a base of the internal cavity and at least partially supports the meltable solid in the cavity; the upper portion and/or the lower portion of the vessel body are configured to be in direct contact with the meltable solid when the meltable solid is in its solid and/or melted state; and at least a portion of the lower portion is configured to be displaceable relative to the upper portion to permit displacement of the meltable solid, or remnants thereof, for enabling removal from the internal cavity, thereby enabling insertion of another meltable solid into the internal cavity.

According to an aspect, a candle vessel includes: a first part and a second part that are arranged to form a vessel body having an internal cavity with an upper opening for receiving a meltable solid; the first part being made with a first material and forming an exterior portion of the vessel body, the exterior portion encompassing a longitudinal axis of the vessel body and extending longitudinally from an upper portion of the exterior portion to a lower portion of the exterior portion; the second part being made with a second material having a greater flexibility than the first material, the second part having a lower portion arranged below the internal cavity; wherein the second part is configured to flex in response to an engagement force acting upon the lower portion of the second part for providing displacement of the meltable solid, or remnants thereof, thereby enabling removal of the meltable solid or the remnants from the internal cavity through the upper opening.

According to an aspect, a candle vessel includes: a first part and a second part that are arranged to form a vessel body having an internal cavity with an upper opening for receiving a meltable solid; the first part being made with a first material and forming an exterior portion of the vessel body, the exterior portion forming a hollow cylinder that encompasses a longitudinal axis of the vessel body and extends longitudinally from an upper portion of the exterior portion to a lower portion of the exterior portion; the second part being made with a second material having a greater flexibility than the first material, the second part having an interior portion that is arranged at least partially internally of the first part and forms at least a bottom portion of the internal cavity, the second part further having an outer portion that forms at least part of an exterior base of the vessel body; wherein the second part is configured to flex in response to an engagement force acting upon the outer portion of the second part for providing displacement of the meltable solid, or remnants thereof, thereby enabling removal of the meltable solid or the remnants from the internal cavity through the upper opening.

According to an aspect, a method includes: (i) having a candle including a holder or candle vessel in which at least a portion of the body is made of a flexible material, and a meltable solid or remnants thereof disposed in the internal cavity; (ii) engaging the lower portion of the candle vessel with an engagement force that causes the lower portion to flex which displaces the meltable solid or the remnants in the cavity; and (iii) removing the meltable solid or the remnants from the internal cavity of the candle vessel. According to an aspect, a refillable, reusable, candle vessel is provided in which at least an interior bottom portion of the vessel is made of a flexible material that allows a user to flex or displace this portion of the vessel, which displaces and releases the remaining wax in the vessel's interior from sticking to the interior lining of the vessel.

According to an aspect, the interior bottom portion may be made of a flexible, resilient, non-adhesive and heat-resistant material which facilitates emptying the candle vessel of remnant wax.

According to an aspect, a refillable, reusable, candle vessel is provided that is reusable many times to reduce costs for consumers as well as reduce waste and negative environmental impact, which is useful for regular consumers, people interested in sustainable products, and frequent candle users.

According to another aspect, a candle holder is provided including a body in which at least a portion of the body is made of a flexible material that permits displacement and removal of remnant resolidified melt.

According to another aspect, a kit is provided, including: a refillable/reusable candle or candle holder/vessel, one or more refillable wax inserts; and product packaging containing the candle/candle holder and wax inserts.

According to another aspect, a refillable wax insert is provided which is specifically adapted for use with a reusable candle vessel.

According to another aspect, a hard shell is provided which is adapted for use with a reusable candle or candle vessel, in which the hard shell is removable/replaceable to permit other hard shells to be used in cooperation with the remaining portion of the candle vessel.

The exemplary reusable/refillable candle may be adapted to be "green" or environmentally friendly, such that the vessel is reusable many times and the remnant meltable material to be disposed of includes soy-based wax and/or a compostable wick clip.

According to another aspect, a compostable wick clip is provided that is made of a compostable material.

The following description and the annexed drawings set forth certain illustrative embodiments of the invention. These embodiments are indicative, however, of but a few of the various ways in which the principles of the invention may be employed. Other objects, advantages and novel features according to aspects of the invention will become apparent from the following detailed description when considered in conjunction with the drawings.

BRIEF DESCRIPTION OF THE DRAWINGS

The annexed drawings, which are not necessarily to scale, show various aspects of the invention.

DETAILED DESCRIPTION

Figure 1:
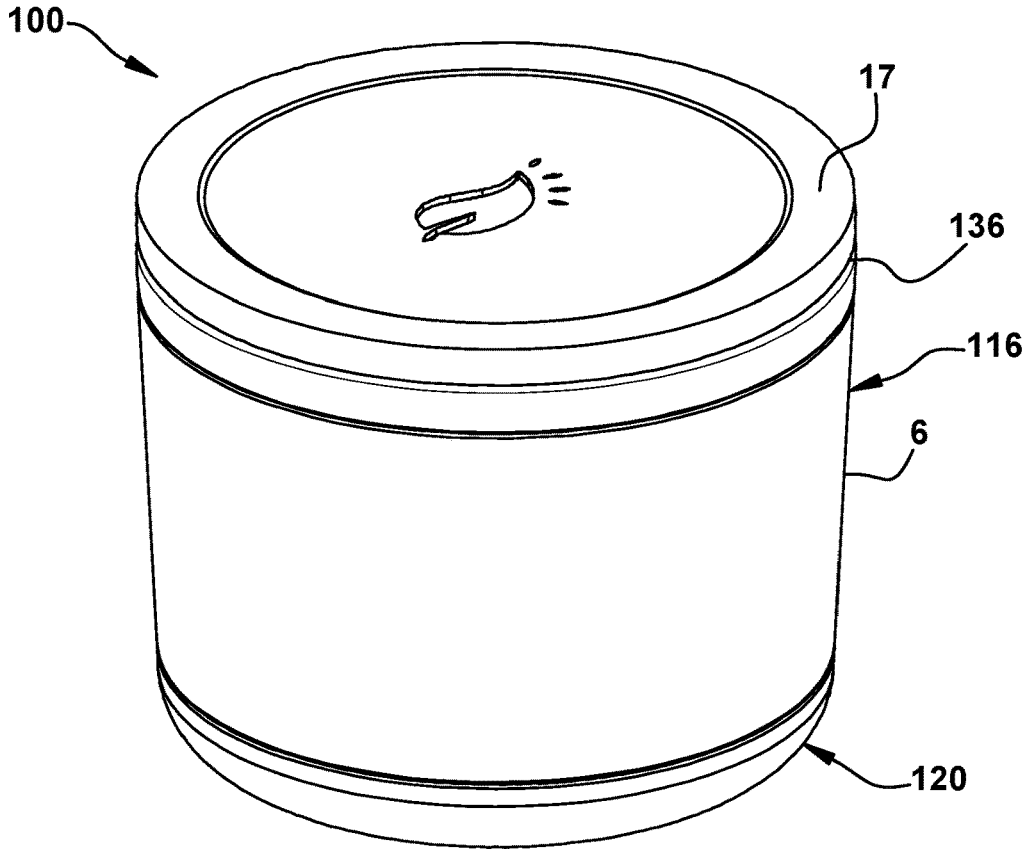
FIG. 1 is a perspective view of an exemplary refillable candle according to an embodiment of the present disclosure.
Figure 2:
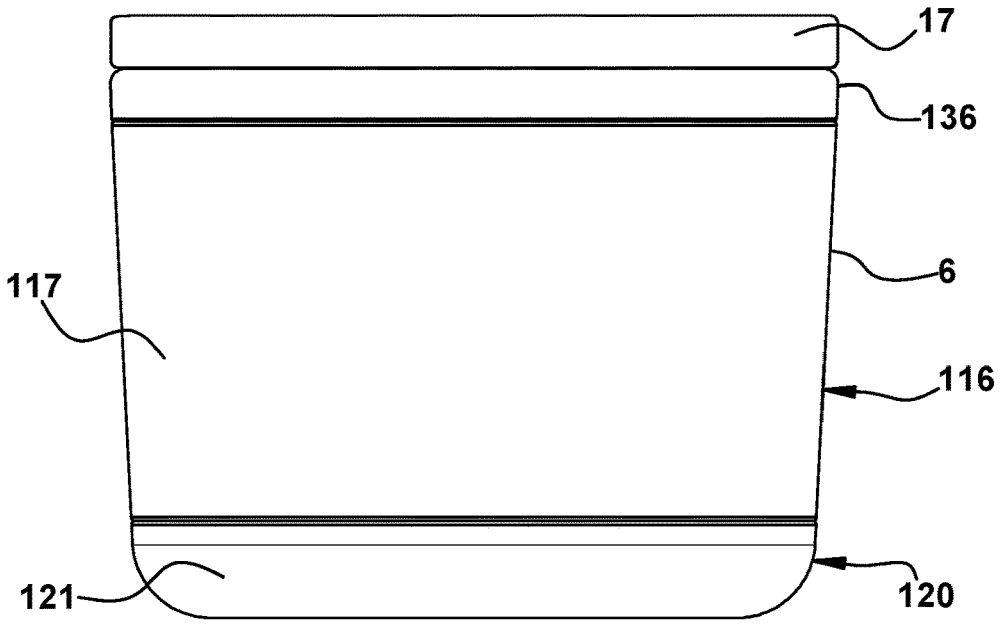
FIG. 2 is a side view of the refillable candle in FIG. 1.
Figure 3:
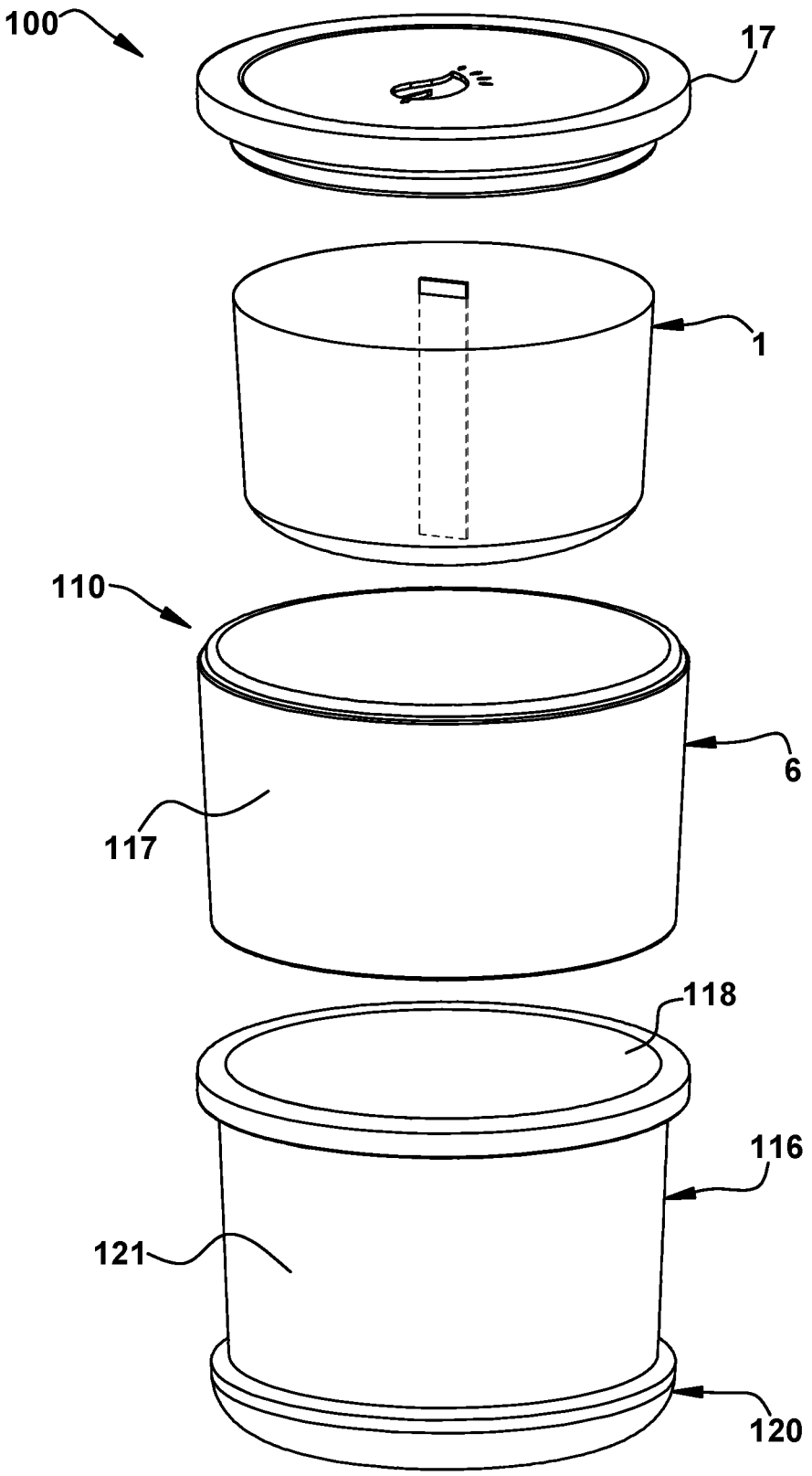
FIG. 3 is an exploded perspective view of the candle in FIG. 1.
Figure 4:
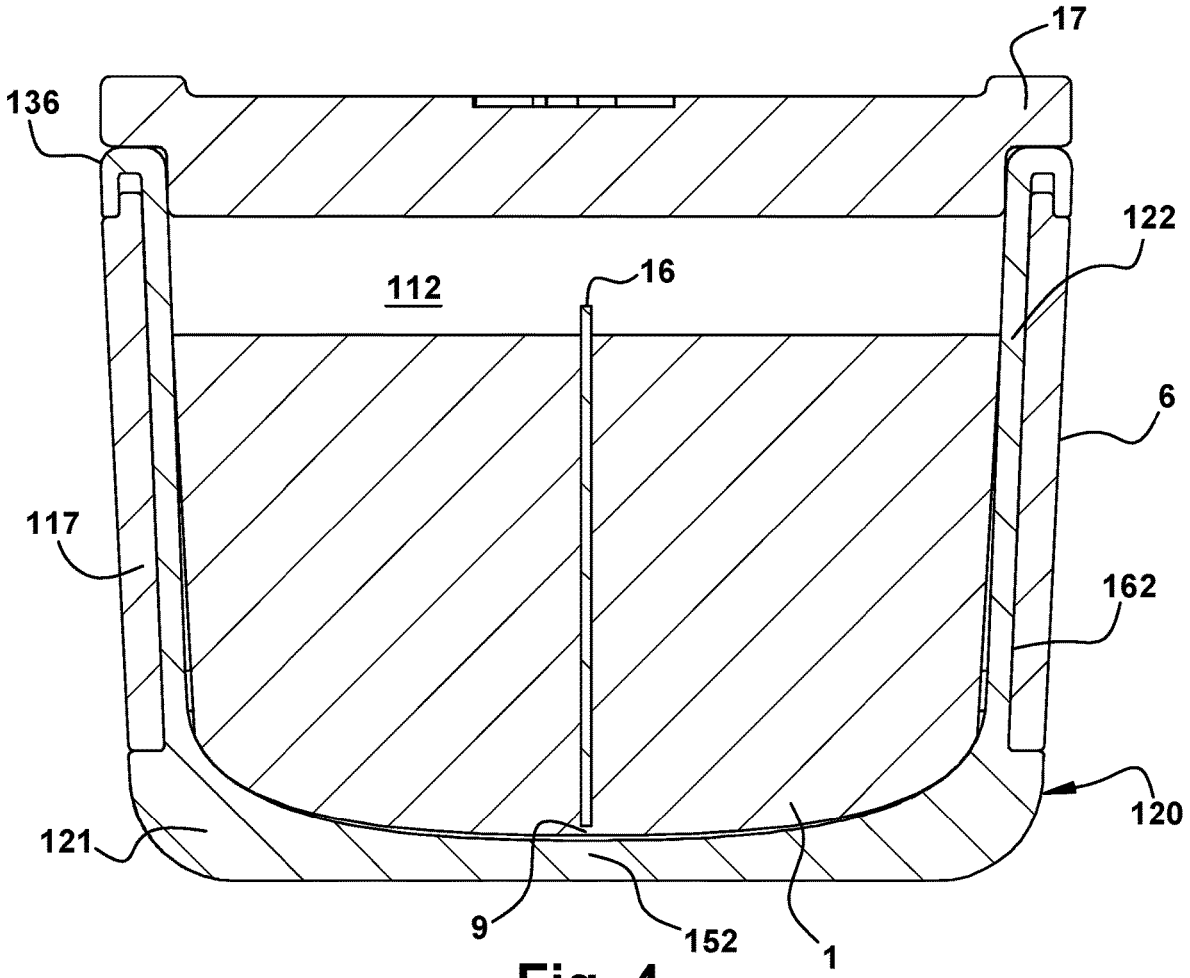
FIG. 4 is a cross-sectional side view of the candle in FIG. 1.

Principles and aspects according to the present disclosure will be described below with reference to the embodiments shown in the drawings, wherein like reference numerals are used to refer to like elements throughout. The principles and aspects according to the present disclosure are not limited to the embodiments described herein. Other embodiments of the like are possible.

Referring to FIGS. 1-4 an exemplary refillable candle 100 according to an embodiment of the present disclosure is shown. Generally, the refillable candle 100 includes a vessel body 110 that forms an internal cavity 112 which contains a meltable solid 1. At least a portion of the body 110 is made of a flexible material that permits displacement and removal of the meltable solid 1, or remnants of the resolidified melt.

The meltable solid 1 may be any suitable meltable solid for the candle 100. For example, the meltable solid 1 may include a tallow or wax, such as a paraffin wax, beeswax, plant-based wax, soy wax, or the like. Generally, the meltable solid 1 may be vaporizable when melted, and the solid 1 may be fragranced so that when the meltable solid 1 is vaporized, the vapor given off by the meltable solid 1 is a desired aroma. The meltable solid 1 may be melted by providing a flame or the like. As shown, the meltable solid 1 may contain an ignitable/burnable wick 16 that is disposed within the meltable solid 1 and is used to melt the solid 1 and form a melt pool surrounding the wick 16. The wick 16 may be of any suitable construction and material(s). For example, the wick may be a wood reed, or a piece of string or cord such as cotton, that holds the flame of the candle. For example, the string or cord may be made from braided cotton, in which the wick's capillary action determines the rate at which the meltable solid 1 is conveyed to the flame and vaporizes the meltable solid 1.

The exemplary vessel body 110 of the refillable candle 100 includes an upper portion 116 and a lower portion 120. At least part of the upper portion 116 forms at least a portion of one or more sidewalls of the internal cavity 112. The upper portion 116 also contains at least one opening 118 for accessing the internal cavity 112. The opening 118 may be used to provide access to ignite the burnable wick 16, and/or may be used to remove the meltable solid 1 (or a remnant thereof), or insert the meltable solid 1 (or a replacement meltable solid 1). As shown, at least part of the lower portion 120 forms at least part of an exterior base of the vessel body 110.

In exemplary embodiments, the vessel body 110 includes a first part 117 and a second part 121 that are operatively coupled to each other, and which may be discrete or decouplable with respect to each other. The first part 117 may be made of a first material and the second part 121 may be made of a second material. The first material may be different from the second material, or the first and second materials may be the same. The second material may be more flexible than the first material, or the first material may be more flexible than the second material.

As shown, the second part 121 may form at least part of the lower portion 120 of the vessel body 110, and the first part 117 may form at least part of the upper portion 116 of the vessel body 110. The first part 117 may form at least a portion of an exterior of the vessel body 110, and the second party 121 may form at least a portion of an interior of the vessel body 110. In some embodiments, the first part 117 may include respective parts of both the upper portion 116 and the lower portion 120 of the vessel body 110. In some embodiments, the second part 121 may include respective parts of both the upper portion 116 and the lower portion 120 of the vessel body 110. In exemplary embodiments, the upper portion 116 may include or be made with a hard/rigid exterior that is harder (less flexible/more rigid) than the lower portion 120. In embodiments in which the upper portion 116 includes the first part 117 made with the first material and the lower portion 120 includes the second part 121 made with the second material, the first material may be harder (less flexible/more rigid) than the second material. For example, the first material of the upper portion 116 and/or first part 117 (or any other suitable hard exterior portions of the candle) may be made with glass, rigid plastic (such as HDPE, PP, resins), ceramics (such as clay-based), natural stones or other hard natural materials (such as onyx or granite and may be resin bound), or the like.

As shown, the upper portion 116 may include the hard/rigid exterior in the form of a shell 6 which may be in the form of a hollow body or tube. In the illustrated embodiment, the shell 6 is formed with the first part 117 made with the first material. The shell 6 may having openings at the top and bottom, and may cylindrical, polygonal, or the like. As shown, the shell 6 may taper radially inwardly in a longitudinally downward direction.

In the illustrated embodiment, the upper portion 116 also includes an inner portion 122 radially inward of the outer shell 6, in which the inner portion 122 forms the sidewall of the internal cavity 118. As shown, the inner portion 122 of the upper portion 116 is unitary with the lower portion 120 of the vessel body and thus the inner portion 122 is formed by the second part 121 made with the second material. It is understood, however, that the inner portion 122 could otherwise be operatively coupled to the lower portion 120. In alternative embodiments, the shell 6 may be formed in a single piece with the inner portion 122, or there may be no shell 6.

As shown, the inner portion 122 and/or the lower portion 120 may be surrounded by the shell 6 through the opening at the top and bottom of the shell 6. As noted above, the exterior shell 6 may be formed by the first part 117 that surrounds at least part of the second part 121. An outer portion of the second part 121 may extend longitudinally lower than a bottom edge of the first part 117. The outer portion of the second part 121 includes a radially outwardly protruding lip 162 that underlies the bottom edge of the first part 117. The shell 6 may be sized such that an exterior side surface of the shell 6 is flush with an exterior side surface of the flexible lower portion 120. This may be achieved by disposing the shell 6 in a radially recessed surface (relative to the lip 162) in an exterior portion of the sidewall of the upper portion 116. The shell 6 may be adhered to the sidewalls of the upper portion 116 or be removable. For example, the shell 6 may be slidably removable, or the shell 6 may be made out of two distinct pieces that wrap around the inner portion 122 and connect together, or the like.

The inner portion 122 of the upper portion 116 may include a radially outwardly protruding lip 136 which overlies an outer portion of the shell 6 and is disposed about the upper portion 116. As show, the protruding lip 136 may be formed as a J-shaped hook. Alternatively, the protruding lip 136 may be L-shaped. Additionally, the protruding lip 136 may also be removed such that when the shell 6 surrounds the inner portion 122 the top of the shell 6 and the inner portion 122 are flush with one another. This will allow for easy removal of the shell 6, which may be useful in helping to remove the remnants 24.

In the illustrated embodiment, the upper portion 116 and/or the lower portion 120 of the vessel body 110 are configured to be in direct contact with the meltable solid 1 when the meltable solid is in its solid and/or melted state. In addition, at least a portion of the lower portion 120 is configured to be displaceable relative to the upper portion 116 to permit displacement of the meltable solid 1, or remnants 24 of the meltable solid 1 (described in further detail later) from the vessel body 110, in order to enable removal of the meltable solid 1 or remnants 24 from the internal cavity 112. This enables another meltable solid 1 to be easily inserted into the internal cavity 112. In the illustrated embodiment, the second part 121 made with the second material is displaceable by flexure.

The refillable candle may also include a lid 17 that covers the opening 118. The lid 17 may be used to help extinguish the wick 16 when it is burning, such as for example by placing the lid 17 on top of the opening 118 of the burning refillable candle 100, thus resulting in a lack of oxygen and extinguishing the flame. This may also be beneficial to keep the candle's fragrance intact. In addition, the lid 17 serves to help prevent dust and other debris from entering the meltable solid 1. The lid 17 may be configured to loosely rest on the top of the opening 118 and/or be sealing coupled to the opening, such as for example, with a sealing circular ring. The lid 17 may also hinged to the top of the vessel body 110 if desired.

Figure 5A:
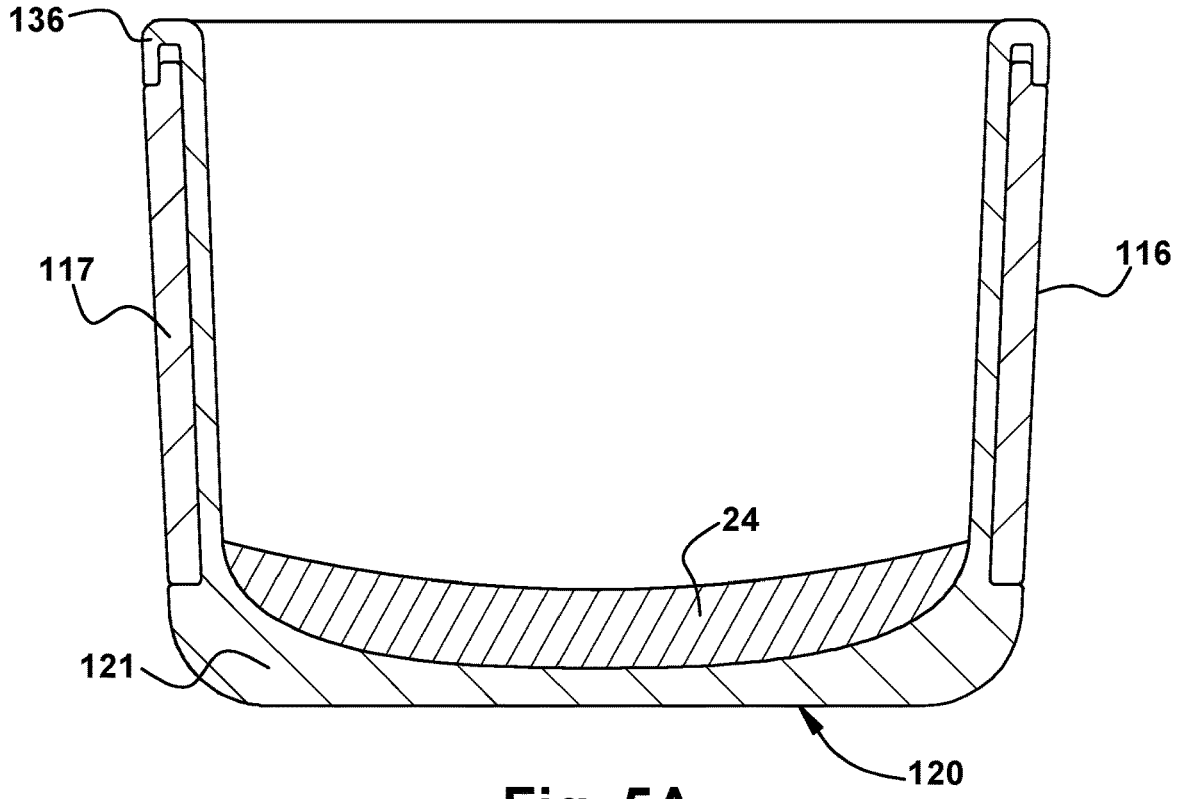
FIGS. 5A-5C show an exemplary method of removing a remnant meltable solid such as wax by flexing a lower portion of the vessel in FIG. 1.
Figure 5B:
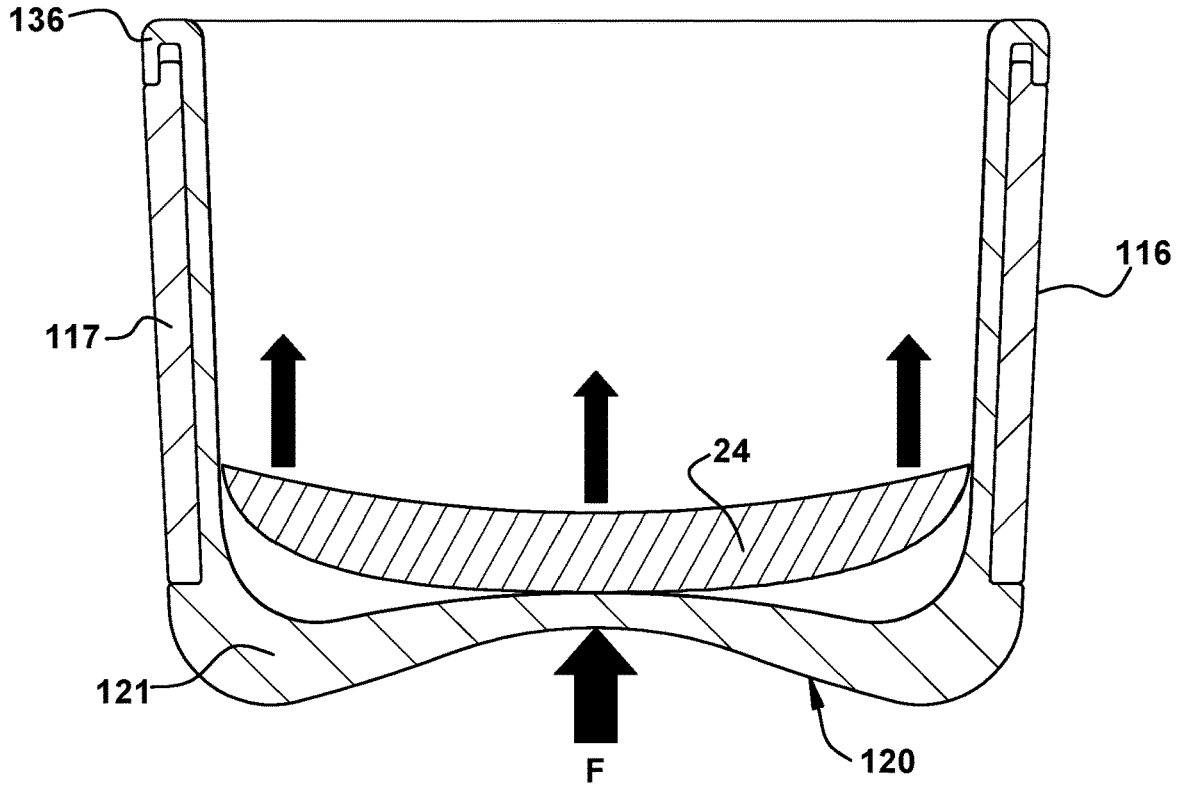
Figure 5C:
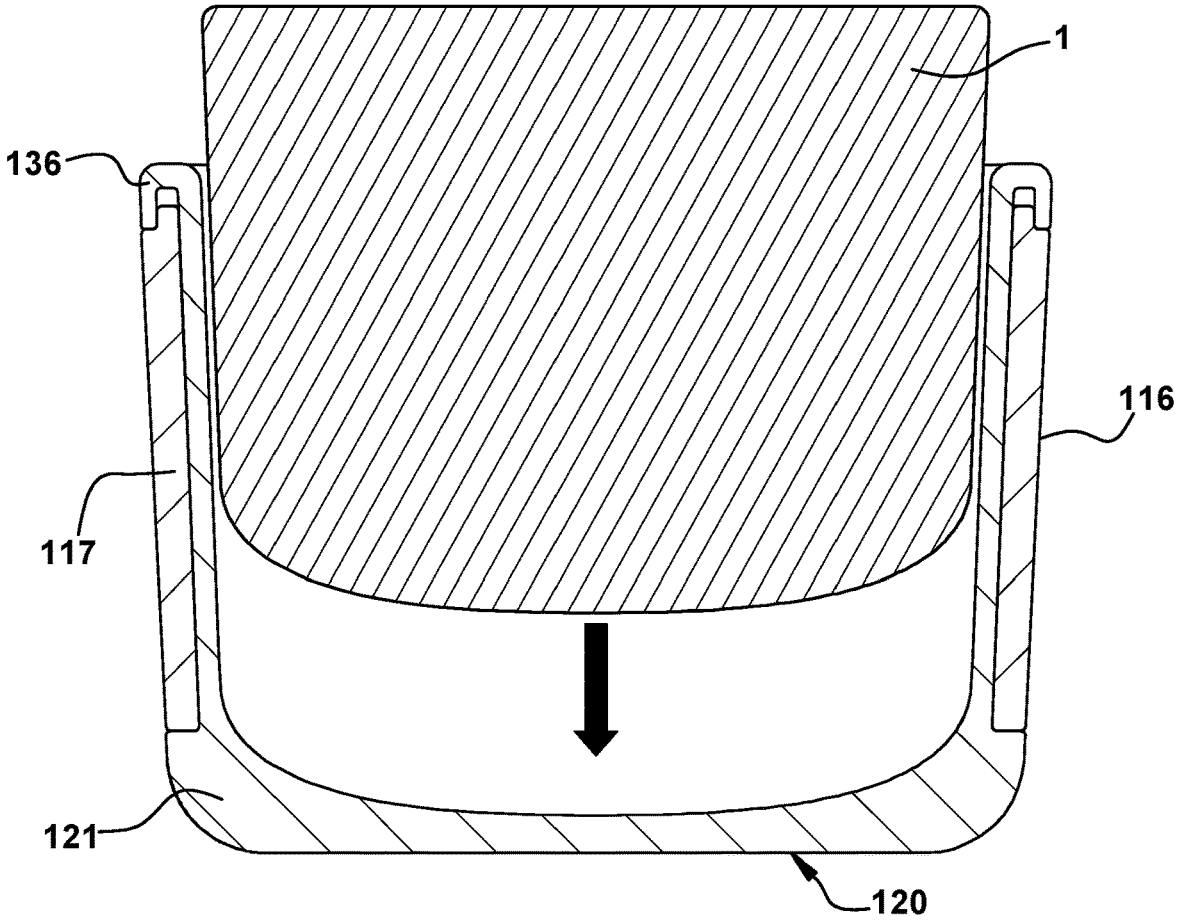

Turning to FIGS. 5A-5C, the refillable candle 100 is shown in an exemplary operation for removing a remnant 24 of the resolidified meltable material 1. FIG. 5A shows the refillable candle 100 where the meltable solid 1 has been sufficiently diminished, such as by vaporization through ignition, leaving the remnants 24 from the meltable solid 1 at a base 9 of the internal cavity 112. The base 9 may be hemispherical or include rounded surfaces in which the meltable solid 1 has a corresponding hemispherical or rounded bottom surface to be received within the base 9 of the internal cavity 112.

Turning to FIG. 5B, the lower portion 120 of the refillable candle 100 is configured to be sufficiently flexible to permit sufficient flexing of the lower portion 120, thereby displacing the remnant material 24. The lower portion 120 may be made entirely of a flexible material or partially of a flexible material. In the illustrated embodiment, the second part 121 is made with a flexible material to provide flexibility to the lower portion 120. As shown in the illustration, when a force F is applied to the lower portion 120 of the refillable candle 100, such as by pressing the lower portion 120 upwards with a thumb(s) as indicated by the arrow F, the lower portion 120 is displaced upwards relative to the upper portion 116. The flexible lower portion 120 is arranged below meltable solid 1, and as a result, the remnant material 24 that is located at the base 9 of the internal cavity 112 is ejected upwards and away from the base 9 of the internal cavity 112 in response to the engagement force F acting upon the lower portion 120 (e.g., lower surface of second part 121). Subsequently, the vessel body 110 may be turned upside down to facilitate emptying the remnants 24 from the internal cavity 112.

The flexible portion of lower portion 120 (e.g., at least part of the second part 121) is configured to have the ability to be repeatedly flexed, bent, bowed, turned, or twisted without cracking, breaking, or showing other permanent damage. Further, the lower portion 120 should be sufficiently flexible to be capable of breaking a solidified melt pool region that forms a seal with the internal surface of the internal cavity 112. For example, the lower portion 120 may be flexible in a range of the size of the melt pool (or region sealing against the internal surface), such as for example, flexible in a range from 1/16-inch to ½-inch. As an additional reference, the meltable/resolidified solid 1 may be fractured by applying a strain to the meltable solid 1 in a range from about 1% to about 3%, such as about 2%. In exemplary embodiments, the lower portion 120 (e.g., at least part of the second part 121) is resilient such that after being flexed, the lower portion 120 will return to the same shape, or substantially the same shape, when the force F is removed.

Alternatively or additionally to being flexible from the bottom, the lower portion 120 may be squeezable from its sides which form lower sidewall portions of the internal cavity 112. Accordingly, this allows deformation of the cross-sectional shape of the lower portion 120 relative to its original shape, such as for example, to make the lower portion 120 oblong or elliptical compared to circular. This forces the remnants 24 from the meltable solid 1 to release from the sidewalls in the internal cavity 112, thus facilitating the ejection process described previously.

In exemplary embodiments, the lower portion 120 is sufficiently flexible to displace the meltable solid 1 (or resolidified meltable solid 1) while still being sufficiently rigid to support itself and the upper portion 116, including the meltable solid 1 and the shell 6, of the vessel. For example, the lower portion 120 and/or upper portion 116 may have wall thickness(es) sufficiently sized to self-support a meltable solid 1 of about 6-12 ounces and an overall vessel 110 weight in a range from 8-20 ounces. The wall thickness of the upper 116 and/or lower portions 120 may be in a range of 1 mm to 15 mm, such as for example, 1, 2, 3, 4, 5, 6, 7, 8, 9, 10, 11, 12, 13, 14, 15 mm.

The refillable candle 100 may be configured with a width of the internal cavity 112 and size of the wick 16 being such that a melt pool of the meltable solid 1 extends to the internal surface(s) forming the internal cavity 112 (i.e., no tunneling). The depth of the melt pool of the meltable solid 1, when melted, may be in a range from about 1/16-inch to ½-inch deep. The material forming the internal cavity 112, including respective portions of the upper portion 116 and lower portion 120, may be made of a material that is impermeable to the meltable solid 1, when melted, and which is non-adhesive with (does not cause sticking of) the melted material. In addition, the upper portion 116 and/or lower portion 120 preferably is/are made of a heat-resistant material, such as a material that can withstand continuous use at temperatures of a melt pool of the meltable solid 1, which when melted may be in the range from 50-300° F. It is understood, however, that higher or lower temperature thresholds may be used for the material of the upper portion 116 and/or lower portion 120.

Examples of material(s) that can permit sufficient flexibility of at least the lower portion 120, such as the second material of the second part 121, include, but are not limited to, flexible polymers, resilient polymers, elastomers, or the like. For example, the material may be a polymer-elastomer or rubber and/or a thermoplastic elastomer or thermoset elastomer, such as silicone rubber. Such material(s) also provide sufficient rigidity when formed with suitable wall thickness for the lower portion 120 and/or upper portion 116. Such material(s) also provide sufficient resiliency to return to its original shape after an engagement force is removed. Such material(s) also may provide sufficient heat-resistance for the lower portion 120 and/or upper portion 116 when exposed to the heat generated by the flame and/or melt pool without degradation. Such material(s) also may be sufficiently impermeable and anti-stick with the meltable solid (e.g., wax) when resolidified to help facilitate the release of the remnant material 24.

In addition to the foregoing, at least the upper portion 116 may be made with a material or have a wall thickness that provides translucency or is semi-transparent, such as for example, being white with a thin wall structure, to enable visual glow from the outside by burning the wick 16. A clear glass shell 6 would promote such visibility, for example.

Referring to FIG. 5C, after the remnant 24 has been removed, a new meltable solid 1 can be inserted into the vessel body 110 of the refillable candle 100. This operation is indicated by the arrow located between the base 9 of the lower portion 120 and the meltable solid 1.

Figure 6:
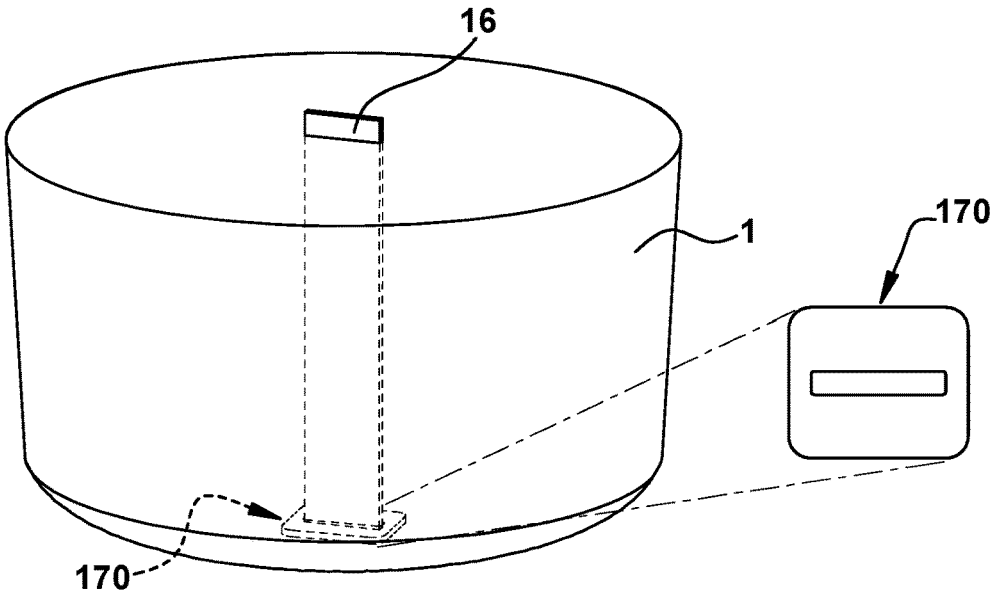
FIG. 6 shows an exemplary meltable solid with a compostable wick clip according to an embodiment of the present disclosure.

Turning to FIG. 6, an exemplary embodiment of the meltable material 1 including a wick 16 and a wick clip 170 is shown. The wick clip 170 may be made of a compostable material, such as for example, wood or paper-based material. This includes wood or wood-like material that may comprise wood or wood particles adhered, bonded, pressed and/or cut to size, and which may be dipped or coated with a wax to adhere or seal the wick clip. The wick clip 170 may also be made from bamboo material, such as bamboo composites, or the like. More specifically, the wick clip 170 may include wood from a family of hardwoods, softwood, or tropical woods, such as Adler, Cedar, Cherry, Cypress, Poplar, Silverbell, Spruce, Rimo, and Pillanwood, Aspen, Basswood, Beech, Birch, Hard Maple, Pacific Yew, Pine, Witch Hazel, or the like. The meltable solid 1 in any of the embodiments described herein is not necessarily limited to a single wick 16 or wick clip 170 and may have multiple wicks 16 and wick clips 170.

Turning to FIGS. 7A-12, additional embodiments of a refillable candle 100 are shown. The refillable candles 100 illustrated in FIGS. 7-12 are substantially the same as the above-described refillable candle 100 in FIGS. 1-5C, and consequently the same reference numerals are used to denote structures corresponding to the same or similar structures in the refillable candle 100. In addition, the foregoing description of the refillable candle 100 in FIGS. 1-5C is equally applicable to the refillable candle 100 in FIGS. 7-12, except as noted below. Moreover, it is understood that aspects of the refillable candles 100 in any embodiment may be substituted for one another or used in conjunction with another where applicable.

Figure 7A:
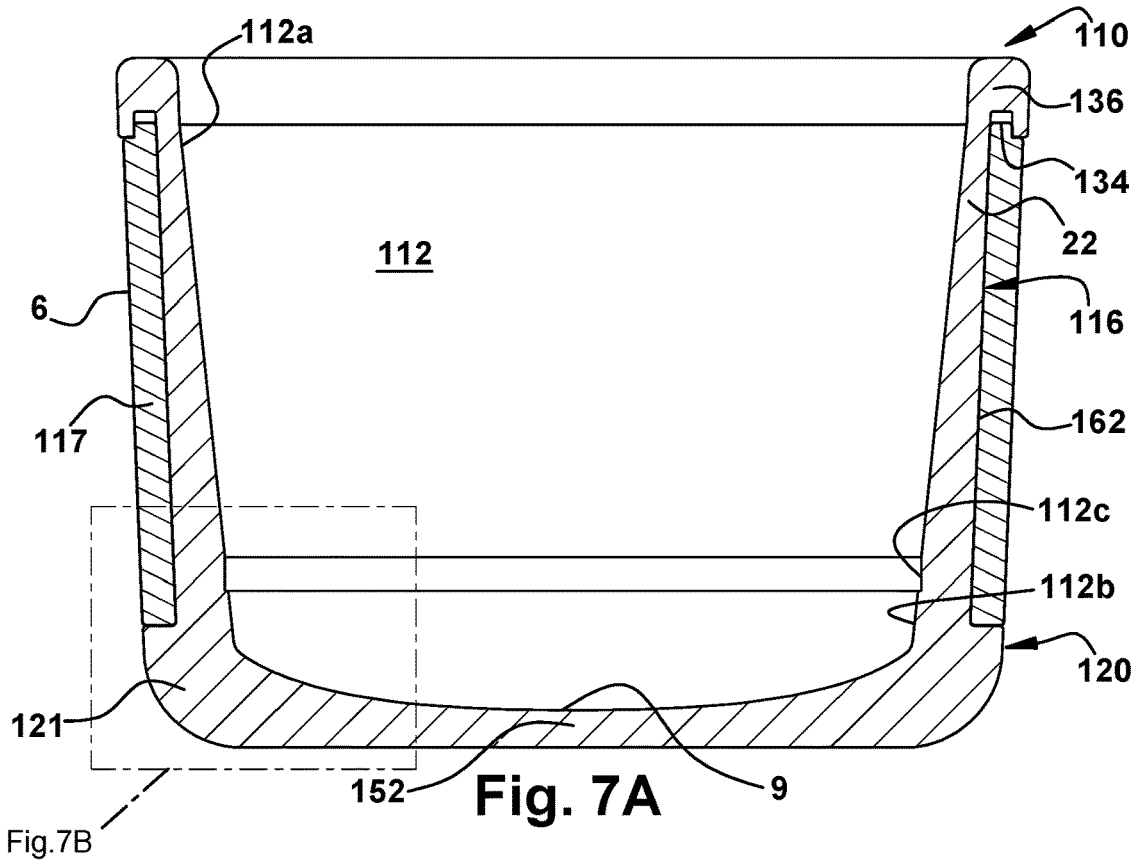
FIG. 7A shows an exemplary refillable candle with a stepped surface according to another embodiment of the present disclosure.
Figure 7B:
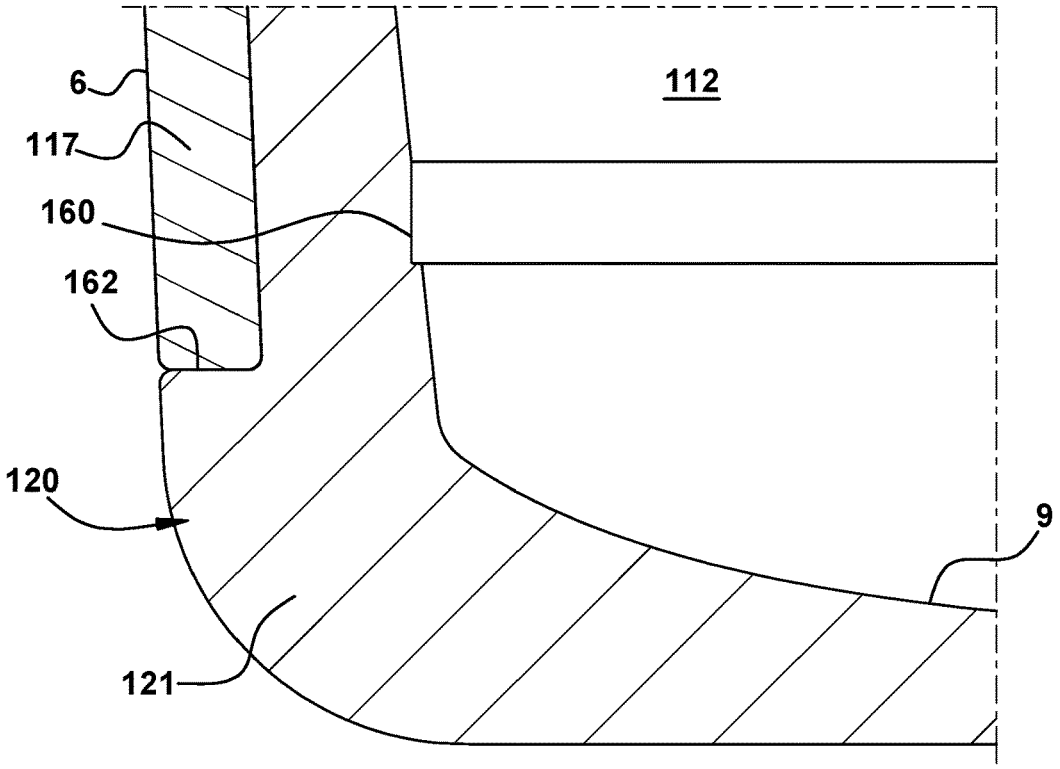
FIG. 7B shows a detailed view of the stepped surface shown in FIG. 7A.

FIGS. 7A and 7B show another exemplary embodiment of a refillable candle 100 which is substantially the same as the refillable candle 100 described above, except that the internal cavity 112 may include a stepped surface 160. Similarly to the above-described candle, the candle 100 in FIGS. 7A and 7B include vessel body 110 having lower portion 120 that forms a base 9 of the internal cavity 112 and at least partially supports a meltable solid 1 that is disposed in the cavity 112. The lower portion 120 has a reducing wall thickness portion 152 toward a center of the base 9 of the internal cavity 112 to facilitate flexibility in this region which will assist in pushing the re-solidified meltable solid 1 (or remnant 24) out. The internal cavity 112 is formed to taper in the downward direction such that an upper part 112*a* of the internal cavity 112 is wider than a narrower lower portion 112*b*.

The stepped surface 160, or shelf, is located closer to the base 9 of the internal cavity 112 than the top of the internal cavity 112. The stepped surface 160 may serve as a visual indicator that resolidified meltable solid 1 (or remnant 24) should be removed and replaced. Moreover, the stepped surface 160 provides for a wider region 112*c* of the internal cavity 112 above the step or shelf 160, and a narrower region 112*b* of the internal cavity below the step or shelf. This will help to make pushing the remnant 24 upwards easier by allowing the resolidified meltable solid 1 to release from the sidewalls 116 as a result of the expanded wider region 112*c* being wider than the remnant material 24 contained in the lower region 112*b*.

Figure 8:
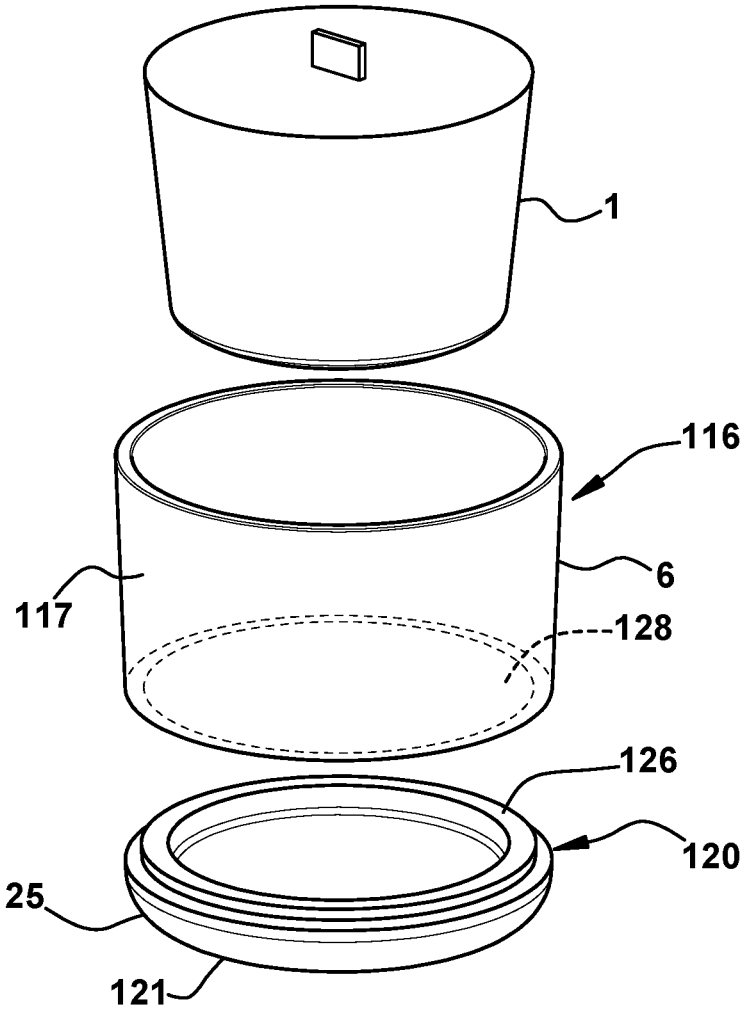
FIG. 8 shows an exemplary refillable candle according to another embodiment the present disclosure.

FIG. 8 shows another embodiment of a refillable candle 100 which includes upper portion 116, including sidewalls and a shell 6, configured to be decouplable from lower portion 120. For example, the lower portion 120 may be threadedly connected to the upper portion such that the lower portion 120 can be connected or disconnected from the upper portion 116 by screwing/unscrewing the lower portion 120 from the upper portion 116 or vice versa. Alternatively, as shown, the lower portion 120 may include an upwardly protruding rim 126 that is adapted to be received in an opening or groove 128 in a bottom of the upper portion 116, or (not shown) the lower portion 120 may have an opening or grove into which a downwardly protruding rim is received. In accordance with the previously mentioned embodiments, the decouplable upper portion 116 may be made of a harder, same, or more flexible material than the lower portion 120.

Similarly to the foregoing embodiment(s), the sidewalls of the internal cavity 112 and the shell 6 may be formed in a single piece. Additionally, the upper portion 116, the shell 6, or any other suitable harder exterior portions of the candle may be made with the same materials described above for corresponding components. Furthermore similarly to the foregoing embodiment(s), the upper portion 116 and/or the lower portion 120 may be intermediate portions with further upper portions or lower portions above and/or below.

Figure 9A:
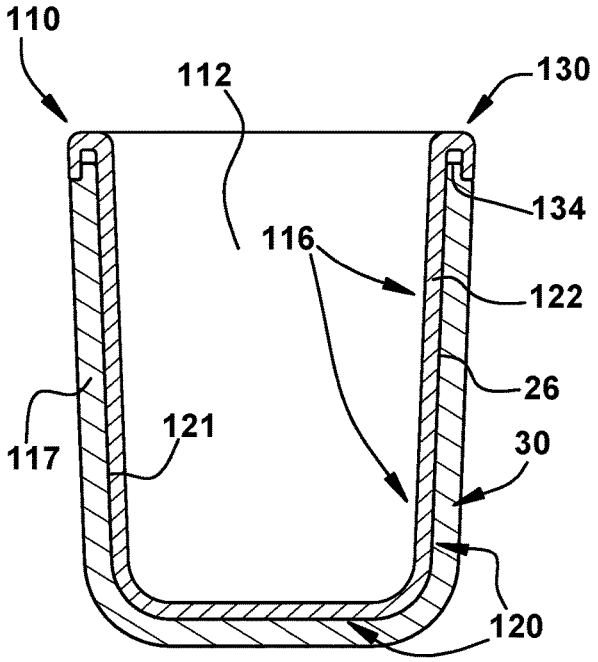
FIG. 9A shows an exemplary refillable candle vessel according to another embodiment of the present disclosure.
Figure 9B:
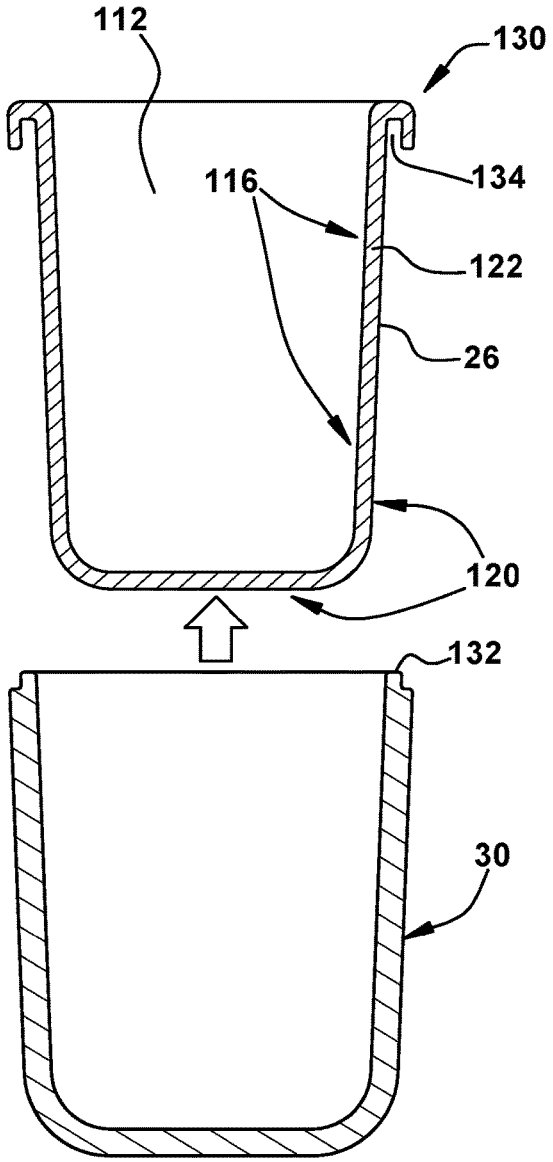
FIG. 9B shows a method of using the refillable candle vessel in FIG. 9A.

In another embodiment shown in FIGS. 9A and 9B, an upper portion 116 and a lower portion 120 of the vessel body may be monolithic with each other. In this case, the monolithic body may be configured as a flexible insert 130 that is insertable into another harder vessel 30. The other harder vessel 30 may include an upwardly protruding rim 132 that is received into a recess 134 in an underside lip of the flexible insert 130 where the opening of the vessel is surrounded by the lip.

Figure 10A:
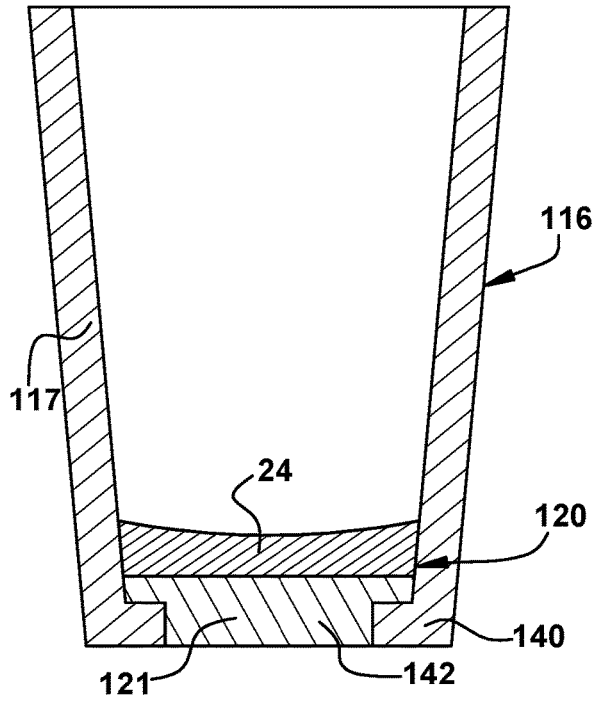
FIG. 10A shows a refillable candle according to another embodiment of the present disclosure.
Figure 10B:
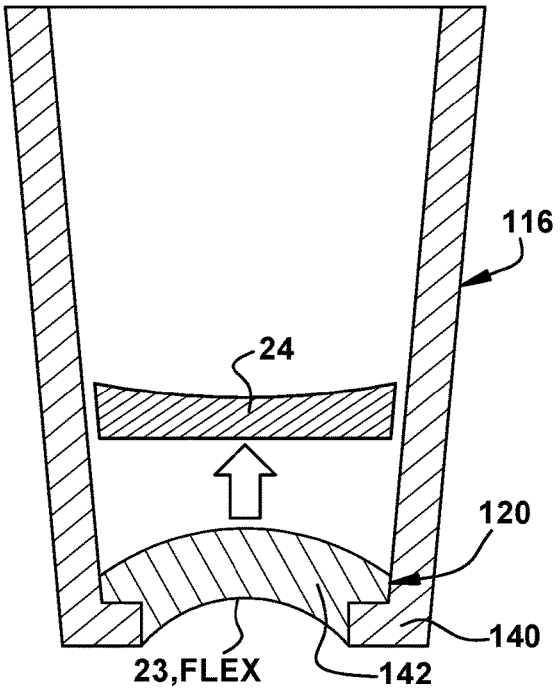
FIG. 10B shows a method of using the refillable candle in FIG. 10A.

Looking now at FIGS. 10A and 10B, another embodiment of a refillable candle 100 is shown. In this particular embodiment, a lower portion 120 includes a first rigid portion 140 (e.g., lower portion of first part 117) that extends radially inwardly to form a rigid rim or frame around a bottom of the refillable candle 100 with a lower opening extending through the bottom. The lower portion includes a flexible portion 142 (e.g., second part 121) with a lower surface that is aligned with the lower opening and is exposed through the rim or frame, such that depression, for example, by pressing the second flexible portion 142 upwards with thumb(s), like a button, displaces the meltable solid 1 (or remnants 24). As shown, an upper portion of the second part 121 may radially overlap with the lower portion of the first part 117, and an upper portion of the second part 121 may form an entirety of a bottom surface of the internal cavity 112. The second part 121 may have a lower portion that extends longitudinally into the lower opening. A bottom surface of the lower portion of the second part 121 may be flush with a bottom surface of the radially inwardly extending bottom portion of the first part 117.

Figure 11A:
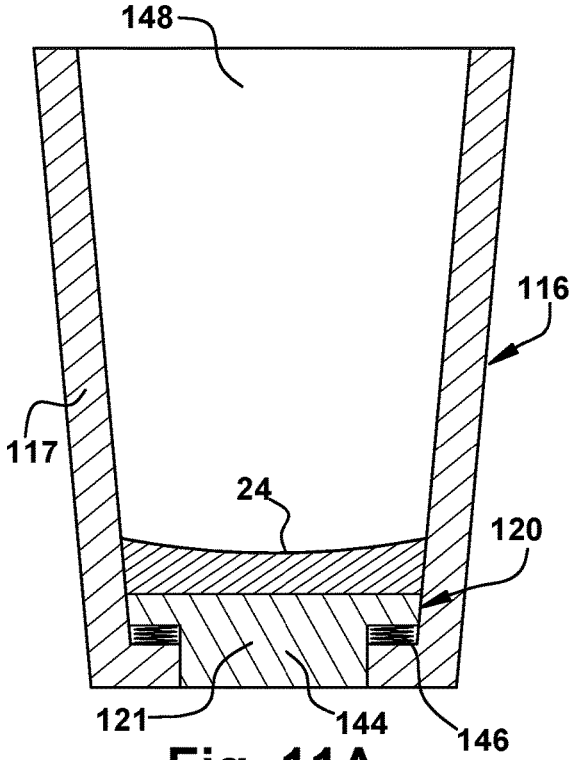
FIG. 11A shows an exemplary refillable candle vessel according to another embodiment of the present disclosure.
Figure 11B:
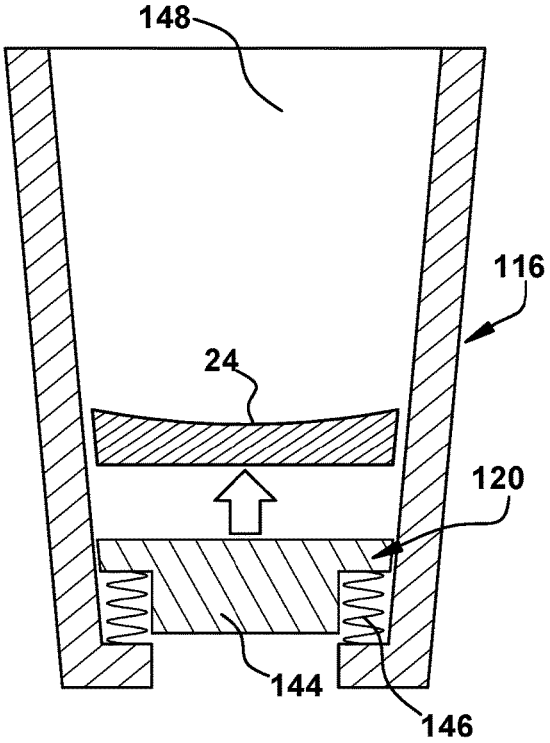
FIG. 11B shows a method of using the refillable candle in FIG. 11A.

FIGS. 11A and 11B show another exemplary refillable candle 100 according to the present disclosure. As shown, a lower portion 120 includes an actuator mechanism that displaces the meltable solid 1. The actuator mechanism may include a piston 144 and an upper portion 116 includes a cylinder 148 (formed from the upper portion 116). The piston 144 may be made from the second part 121, and the cylinder 148 may be made from the first part. The piston 144 and cylinder 148 are operative such that a force exerted against the piston 144 displaces the piston relative to the cylinder 148 to displace the meltable solid 1 or remnants 24. The piston 144 and the cylinder 148 may be coupled together with a biasing member, such as one or more springs 146, rubber bands, or the like, such that a biasing force exerted against the piston 144 displaces the piston 144 relative to the cylinder 148 to displace the meltable solid 1 or remnants 24. Afterwards, the biasing member(s) return the piston 144 to its original position. Alternatively, no biasing member may be provided, and the piston 144 could be returned to its initial position by pushing the replacement meltable solid 1 downward.

Figure 12:
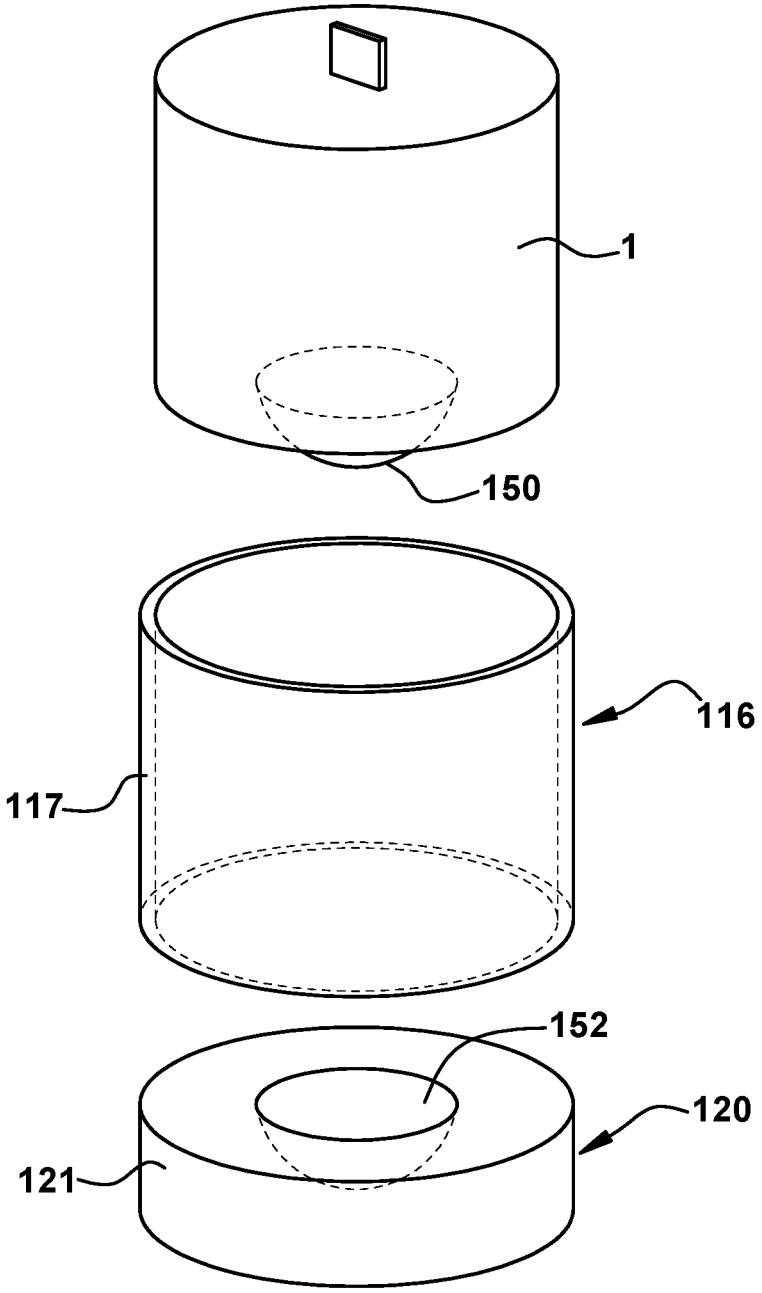
FIG. 12 shows an exemplary meltable solid refill for use with another exemplary candle according to an embodiment of the present disclosure.

FIG. 12 illustrates another exemplary refillable candle 100 according to the present disclosure. As show, an upper portion 116 and a lower portion 120 are couplable together, such as being slidably attachable/detachable with each other. As shown in this embodiment, the meltable solid 1 may have a rounded bottom and/or one or more protrusions 150 that are adapted to fit within a corresponding one or more recesses 152 in the lower portion 120. The lower portion 120 and upper portion 116 may be made of any of the materials described for previous embodiments to help facilitate the removal of the meltable solid 1.

Additionally, in accordance with the embodiments described in FIGS. 1-12, the refillable candle 100 may include ornamentation on the exterior surface of the refillable candle 100, such as on the hard shell 6. For example, there may be labels, printing, impressions or the like, on the exterior of any of the embodiments shown. Furthermore, the refillable candle 100 shown in any embodiment described herein may be adapted for both household and outdoor use, and come provided with consumer packaging that is adapted to fit on a retailer store shelf. In exemplary embodiment(s), the candle or candle vessel of is devoid of a recess for a wick clip and/or is devoid of any other production mold related features.

The refillable candle 100 shown in any previous embodiment may be sold individually or in the form of a kit which may include any of the following: the vessel body 110, one or more refillable meltable solid 1 inserts, and/or product packaging containing the refillable candle 100 and meltable solid 1. The refillable candle 100 may be adapted to be environmentally friendly as to permit the refillable candle 100 to be reused many times, such as for example, 100s or 1,000s of times. An exemplary refillable candle or candle vessel has been described herein.

According to an aspect, a candle holder comprising a body in which at least a portion of the body is made of a flexible material that permits displacement and removal of remnant resolidified melt.

According to an aspect, a candle or candle vessel includes an upper portion and a lower portion. At least a portion of the lower portion of the candle vessel is displaceable relative to the upper portion to allow a meltable solid to be easily removed from the candle vessel. The lower portion may include a flexible, resilient, non-adhesive, and heat-resistant interior part which lines at least a portion of the bottom, and preferably, the entire interior of the vessel. In exemplary embodiment(s), the vessel is wrapped in a sturdy, durable shell for additional design and structure.

According to an aspect, a refillable candle 100 includes: a vessel body 110 having an internal cavity 112; a meltable solid 1 disposed in the internal cavity 112; and an ignitable/burnable wick 16 disposed in the meltable solid 1; wherein the vessel body includes: an upper portion 116 that forms at least a portion of one or more sidewalls of the internal cavity 112, the upper portion having at least one opening 118 for accessing the internal cavity, and a lower portion 120 that forms a base 9 of the internal cavity 112 and at least partially supports the meltable solid 1, 24 in the cavity 112; wherein the upper portion 116 and/or the lower portion 120 of the vessel body are configured to be in direct contact with the meltable solid 1 when the meltable solid is in its solid and/or melted state; and wherein at least a portion of the lower portion 120 is configured to be displaceable relative to the upper portion 116 to permit displacement of the meltable solid 1, or remnants 24 thereof, for enabling removal from the internal cavity 112, thereby enabling insertion of another meltable solid 1 into the internal cavity 112.

According to an aspect, a candle vessel includes: a first part and a second part that are arranged to form a vessel body having an internal cavity with an upper opening for receiving a meltable solid; the first part being made with a first material and forming an exterior portion of the vessel body, the exterior portion encompassing a longitudinal axis of the vessel body and extending longitudinally from an upper portion of the exterior portion to a lower portion of the exterior portion; the second part being made with a second material having a greater flexibility than the first material, the second part having a lower portion arranged below the internal cavity; wherein the second part is configured to flex in response to an engagement force acting upon the lower portion of the second part for providing displacement of the meltable solid, or remnants thereof, thereby enabling removal of the meltable solid or the remnants from the internal cavity through the upper opening.

According to an aspect, a candle vessel includes: a first part and a second part that are arranged to form a vessel body having an internal cavity with an upper opening for receiving a meltable solid; the first part being made with a first material and forming an exterior portion of the vessel body, the exterior portion forming a hollow cylinder that encompasses a longitudinal axis of the vessel body and extends longitudinally from an upper portion of the exterior portion to a lower portion of the exterior portion; the second part being made with a second material having a greater flexibility than the first material, the second part having an interior portion that is arranged at least partially internally of the first part and forms at least a bottom portion of the internal cavity, the second part further having an outer portion that forms at least part of an exterior base of the vessel body; wherein the second part is configured to flex in response to an engagement force acting upon the outer portion of the second part for providing displacement of the meltable solid, or remnants thereof, thereby enabling removal of the meltable solid or the remnants from the internal cavity through the upper opening.

According to an aspect, a method includes: (i) having a candle including a holder or candle vessel in which at least a portion of the body is made of a flexible material, and a meltable solid or remnants thereof disposed in the internal cavity; (ii) engaging the lower portion of the candle vessel with an engagement force that causes the lower portion to flex which displaces the meltable solid or the remnants in the cavity; and (iii) removing the meltable solid or the remnants from the internal cavity of the candle vessel.

Embodiment(s) according to the present disclosure may include one or more features of the foregoing aspects, separately or in any suitable combination, which may be combined with one or more of the following additional features, which may be included separately or in any suitable combination.

In exemplary embodiment(s), the interior portion of the second part includes an internal surface that forms an entirety of the internal cavity of the vessel body.

In exemplary embodiment(s), the internal cavity includes a stepped surface that is located closer to the bottom portion of the internal cavity than a top portion of the internal cavity.

In exemplary embodiment(s), the stepped surface provides a wider region of the internal cavity above the stepped surface and a narrower region of the internal cavity below the stepped surface.

In exemplary embodiment(s), the outer portion of the second part extends longitudinally lower than a bottom edge of the first part.

In exemplary embodiment(s), the outer portion of the second part includes a radially outwardly protruding lip that underlies the bottom edge of the first part.

In exemplary embodiment(s), second part forms an entirety of the exterior base of the vessel body.

In exemplary embodiment(s), the hollow cylinder formed by the first part is in the form of a tubular shell that surrounds at least a portion of the second part and tapers radially inwardly in a longitudinally downward direction.

In exemplary embodiment(s), the second material is a resilient elastomer.

In exemplary embodiment(s), the first material is a rigid plastic, glass, metal, or ceramic.

In exemplary embodiment(s), the exterior portion forms a hollow cylinder.

In exemplary embodiment(s), the second part has an interior portion that is arranged at least partially internally of the first part and forms at least a bottom portion of the internal cavity, the second part further having an outer portion that forms at least part of an exterior base of the vessel body.

In exemplary embodiment(s), the lower portion of the exterior portion includes a radially inwardly extending bottom portion that forms a lower rim at a base of the vessel body, with a lower opening extending through the bottom portion.

In exemplary embodiment(s), the second part is arranged at least partially internally of the first part with at least a portion of the second part being aligned with the lower opening such that the second part is engageable via the lower opening.

In exemplary embodiment(s), an upper portion of the second part radially overlaps with the lower portion of the exterior portion.

In exemplary embodiment(s), the upper portion of the second part forms entirety of a bottom surface of the internal cavity.

In exemplary embodiment(s), the second part has a lower portion that extends longitudinally into the lower opening.

In exemplary embodiment(s), the radially inwardly extending bottom portion of the first part surrounds at least part of the lower portion of the second part.

In exemplary embodiment(s), a bottom surface of the lower portion of the second part is flush with a bottom surface of the radially inwardly extending bottom portion of the first part.

In exemplary embodiment(s), the upper portion of the first part forms a top edge of the vessel body.

In exemplary embodiment(s), the exterior portion of the first part tapers radially inwardly in a longitudinally downward direction.

In exemplary embodiment(s), at least a portion of the lower portion is configured to be sufficiently flexible to permit sufficient flexing of the lower portion to displace the meltable solid, or remnants thereof, for enabling removal from the internal cavity, thereby enabling insertion of another meltable solid into the internal cavity;

In exemplary embodiment(s), the lower portion is squeezable from its sides which form lower sidewall portions of the internal cavity, such as to deform the cross-sectional shape of the lower portion relative to its original shape and the remnant meltable solid material to enable release of the solid from the sidewalls in the internal cavity.

In exemplary embodiment(s), the upper portion includes or is made with a hard/rigid exterior that is harder than the lower portion.

In exemplary embodiment(s), the vessel body further includes a shell portion that at least partially surrounds the upper portion 116 and/or lower portion 120, the shell portion being made of a material that is harder than the upper and/or lower portion.

In exemplary embodiment(s), the upper portion 116 includes an inner portion 122 that is operatively coupled to or unitary with the lower portion 120, and a shell portion 6, 30 that at least partially surrounds the inner portion 122 and/or lower portion, the shell portion being made of a material that is harder than the upper and/or lower portion.

In exemplary embodiment(s), the holder forms a vessel that is adapted to completely contain a meltable solid 1 and is sized such that a melt pool of the melted solid extends to sidewalls 122 of the vessel to thereby prevent tunneling.

In exemplary embodiment(s), the interior vessel sidewalls 122 that form an internal cavity 112 are formed by the flexible material, and a bottom portion 120 of the vessel that forms at least a bottom of the internal cavity is formed by the flexible material, and wherein the vessel sidewalls 122 are encased by a shell 6 that is harder than the flexible material.

In exemplary embodiment(s), the shell 6 fits within an outer recess 162 formed by the flexible material and optionally is removable from the holder 110.

In exemplary embodiment(s), the vessel sidewalls 122 are removable from the flexible vessel bottom portion 120.

In exemplary embodiment(s), an internal cavity 112 of the vessel includes a stepped surface 160 that facilitates removal of the remnant resolidified material 24.

In exemplary embodiment(s), an internal cavity 112 of the vessel is tapered. In exemplary embodiment(s), the shell portion is a cylindrical shell 6, or tubular shell/hollow cylinder, with openings at the top and bottom, in which the cylindrical shell surrounds the inner upper portion 122 of the vessel body.

In exemplary embodiment(s), the shell is sized such that an exterior side surface of the shell 6 is flush with an exterior side surface of the flexible lower portion.

In exemplary embodiment(s), the shell 6 is disposed in a radially recessed surface in an exterior portion of the sidewall of the upper portion.

In exemplary embodiment(s), the upper portion 116 including the sidewall is decouplable from the lower portion 120.

In exemplary embodiment(s), the decouplable upper portion 116 is made of a harder 6, same, or more flexible material than the lower portion 120.

In exemplary embodiment(s), the lower portion 120 includes an upwardly protruding rim 126 that is adapted to be received in an opening 128 or groove in a bottom of the upper portion 116.

In exemplary embodiment(s), the lower portion having an opening or grove into which a downwardly protruding rim is received.

In exemplary embodiment(s), the upper portion 116, the shell 6, or any other suitable harder exterior portions of the candle are made with glass, rigid plastic, ceramics, natural stones or other hard natural materials.

In exemplary embodiment(s), the upper portion 116 and/or the lower portion 120 are intermediate portions with further upper portions or lower portions above and/or below.

In exemplary embodiment(s), the upper portion 116 and the lower portion 120 are monolithic with each other.

In exemplary embodiment(s), an entirety of the lower portion 120 is made of a flexible material.

In exemplary embodiment(s), the monolithic vessel body is configured as a flexible insert 130 that is insertable into another harder vessel 30.

In exemplary embodiment(s), the other harder vessel 30 includes an upwardly protruding rim 132 that is received into a recess 134 in an underside lip of the flexible insert 130, the opening of the vessel being surrounded by the lip.

In exemplary embodiment(s), an inner portion 122 of the upper portion 116 is made of a flexible, heat-resistant material that directly contacts melt of the meltable material 1.

In exemplary embodiment(s), an inner portion 122 of the upper portion 116 includes a radially outwardly protruding lip 136 that overlies an outer portion, such as a shell 6, disposed about the upper portion.

In exemplary embodiment(s), the flexible portion of lower portion 120 has the ability to be repeatedly flexed, bent, bowed, turned, or twisted without cracking, breaking or showing other permanent damage and returning itself to former shape.

In exemplary embodiment(s), a width of the internal cavity 112 and size of the wick 16 are configured such that a melt pool of the solid 1 when melted extends to the internal surface(s) forming the internal cavity.

In exemplary embodiment(s), the candle is configured such that a depth of the melt pool of the meltable solid when melted is in a range from 1/16-inch to 1/2-inch.

In exemplary embodiment(s), the material forming the internal cavity 112, including respective portions of the upper portion 116 and lower portion 120 are made of a material that is impermeable to the meltable material 1 when melted, and which is non-adhesive with the melted material, so as to facilitate release of the melted remnant material; for example the material forming the internal cavity 112 being made with silicone rubber that is releasable from the melted and resolidified wax.

In exemplary embodiment(s), the lower portion 12 is sufficiently flexible to break a solidified melt pool region that forms a seal with the internal surface of the cavity.

In exemplary embodiment(s), the lower portion 120 is sufficiently flexible to fracture the meltable or resolidified solid.

In exemplary embodiment(s), the lower portion (120) is sufficiently flexible to displace the solid or resolidified meltable material and is sufficiently rigid to support itself and the upper portion of the vessel.

In exemplary embodiment(s), the lower portion 120 and/or upper portion 116 made with flexible material has/have wall thickness(es) sufficiently sized to self-support a meltable solid 1 of about 6-12 ounces and an overall vessel 110 weight in a range from 8-20 ounces.

In exemplary embodiment(s), wall thickness of the upper 116 and/or lower 120 portions made of flexible material are in a range of 1 mm to 15 mm.

In exemplary embodiment(s), at least the lower portion 120 is made of a flexible material, such as an elastomer, and has a wall thickness in a range from 1 mm to 15 mm.

In exemplary embodiment(s), the lower portion 120 has a reducing wall thickness portion 152 toward a center of the bottom 9 of the internal cavity 112 to facilitate flexibility in this region and push the re-solidified material 24 out.

In exemplary embodiment(s), the upper 116 and/or lower portion 120 are made of a heat-resistant material, more particularly a material that can withstand continuous use at temperatures of a melt pool of the meltable material when melted, such as in the range from 50 F to 300 F.

In exemplary embodiment(s), the upper 116 and/or lower 120 portion are made of a material that is impermeable to the meltable material when liquefied.

In exemplary embodiment(s), respective parts of the upper 116, 122 and/or lower portion 120 are made of an elastomer, such as polymer-elastomer or rubber, such as a thermoplastic elastomer or thermoset elastomer, for example silicone rubber.

In exemplary embodiment(s), the one or more sidewalls 116 are cylindrical or polygonal.

In exemplary embodiment(s), a bottom surface (9) of the cavity is hemispherical or includes rounded surfaces.

In exemplary embodiment(s), the candle or a refillable insert for use with the candle has the meltable solid 1 with a rounded bottom; and/or has one or more protrusions 150 adapted to fit within a corresponding one or more recesses 152 in the lower portion 120.

In exemplary embodiment(s), the internal cavity 112 is formed to taper in the downward direction such that an upper part 112*a* of the cavity 112 is wider than a narrower lower portion 112*b*.

In exemplary embodiment(s), the internal cavity 112 includes a stepped surface 160, or shelf.

In exemplary embodiment(s), the stepped surface 160, or shelf, is located closer to the bottom 9 of the cavity 112 than the top of the cavity.

In exemplary embodiment(s), the stepped surface 160, or shelf, serves as a visual indicator that remnant resolidified material 24 e.g., wax should be removed.

In exemplary embodiment(s), the stepped surface 160, or shelf, provides for a wider region 112*c* of the internal cavity 112 above the step or shelf 160, and a narrower region 112*b* of the internal cavity below the step or shelf, in which pushing the remnant resolidified material upwards is more easily releasable from the sidewalls 116 due to the expanded wider region 112*c* being wider than the remnant material 24 contained in the lower region 112*b*.

In exemplary embodiment(s), the lower portion 120 includes a first rigid portion 140 that forms a rigid rim or frame around a bottom of the vessel, and includes a second flexible portion 142 with a lower surface that is exposed through the rim or frame, such that depression of the second flexible portion displaces the meltable solid (1).

In exemplary embodiment(s), the lower portion 120 includes a piston 144 and the upper portion 116 includes a cylinder, the piston and cylinder being operative such that a force exerted against the piston displaces the piston relative to the cylinder to displace the meltable solid.

In exemplary embodiment(s), the piston and cylinder are coupled together with one or more springs 146, such that a biasing force exerted against the piston displaces the piston relative to the cylinder to displace the meltable solid and the spring(s) return the piston to its original position.

In exemplary embodiment(s), the vessel contains only a single cavity for containing a single insertable meltable solid.

In exemplary embodiment(s), the upper portion and/or the lower portion are translucent or semi-transparent.

In exemplary embodiment(s), the upper portion and/or the lower portion are translucent or semi-transparent, such as white with a thin wall structure to enable visual glow from the outside by burning the wick.

In exemplary embodiment(s), an exterior surface of the vessel includes ornamentation, such as labels, printing, impressions or the like.

In exemplary embodiment(s), the meltable solid 1 is vaporizable.

In exemplary embodiment(s), the wick 16 is a wood reed or wood-like material, wherein the wood or wood-like wick may comprise wood or wood particles adhered, bonded, pressed and/or cut to size, and which may be dipped or coated with a wax to seal the wick, in which the wick's capillary action determines the rate at which the melted material is conveyed to the flame and vaporizes the meltable material.

In exemplary embodiment(s), the wick 16 may be from a family of hardwoods, softwood or tropical woods. The preferred wood qualities are: fine to medium, uniform texture, straight, even vertical grain, high to medium density and strength, light to medium weight and shock and split resistant. Preferred wood species or genus include but are not limited to: Adler, Cedar, Cherry, Cypress, Poplar, Silverbell, Spruce, Rimo, and Pillanwood. Cherry and Poplar are the most abundant and commercially available in the United States. Additional preferred species or genus of wood include: Aspen, Basswood, Beech, Birch, Hard Maple, Pacific Yew, Pine and Witch Hazel, due to their fine to medium, uniform texture; and straight, vertical grain as listed above, although these wood families tend to be heavier, denser and softer.

In exemplary embodiment(s), the wick 16 includes a piece of string or cord such as cotton, that holds the flame of the candle, such as made from braided cotton, in which the wick's capillary action determines the rate at which the melted material is conveyed to the flame and vaporizes the meltable material.

In exemplary embodiment(s), the candle 100 is adapted to be "green" or environmentally friendly, such that the vessel is reusable many times and the remnant meltable material to be disposed includes soy-based wax and a compostable wick clip, and also may include a wooden wick.

In exemplary embodiment(s), the candle 100 or meltable material insert 1 includes a compostable wick clip 170 that is made of a compostable material.

In exemplary embodiment(s), the compostable wick clip 170 is made of a wood or paper-based material.

In exemplary embodiment(s), the compostable wick clip 170 includes bamboo material.

In exemplary embodiment(s), the compostable wick clip 170 includes wood from a family of hardwoods, softwood or tropical woods.

In exemplary embodiment(s), the wick clip 170 is sized to accept a planar wooden wick clip.

In exemplary embodiment(s), the candle 100 is adapted for household use.

In exemplary embodiment(s), the candle 100 is provided with consumer packaging and is adapted to fit on a retailer store shelf.

In exemplary embodiment(s), the candle or candle vessel of is devoid of a recess for a wick clip and/or is devoid of other production mold related features.

In exemplary embodiment(s), an entirety of the candle holder or candle vessel is made of a flexible material, such as silicone.

In exemplary embodiment(s), the candle or candle vessel further includes a lid 17 that covers the opening.

According to another aspect, a method of using the candle or candle holder is provided according to any of the foregoing.

According to another aspect, a method of marketing or selling the candle according to any of the preceding is provided.

According to another aspect, a method of providing a refillable candle includes: providing the candle or candle holder according to any of the foregoing; and providing a refillable insert, such as a solidified wax.

According to another aspect, a kit includes: the candle or candle holder/vessel according to any of the foregoing, one or more refillable wax inserts; and product packaging containing the candle/candle holder and wax inserts.

According to another aspect, a refillable wax insert adapted for use with the candle or candle holder according to any of the preceding is provided.

According to another aspect, a compostable wick clip is provided according to any of the foregoing.

According to another aspect, a hard shell adapted for use with the candle or candle vessel/holder according to any of the foregoing is provided, optionally in which the hard shell may be removable to permit other hard shells to be used in cooperation with at least the displaceable lower portion.

According to another aspect, the shell portion is adhered to the upper portion.

According to another aspect the shell portion is adhered to the upper portion by glue, double sided tape, or the like.

According to another aspect, the protruding lip forms an orthogonal L-shape.

According to another aspect, the protruding lip forms an orthogonal J-shape.

According to another aspect, an inner portion of the upper portion is surrounded by an outer portion, such as a shell; and a top of the inner portion is flush with a top of the outer portion.

It is to be understood that terms such as "top," "bottom," "upper," "lower," "left," "right," "front," "rear," "forward," "rearward," and the like as used herein may refer to an arbitrary frame of reference, rather than to the ordinary gravitational frame of reference.

It is to be understood that all ranges and ratio limits disclosed in the specification and claims may be combined in any manner. All values or the term "about" as used herein refers to any value which lies within the range defined by a variation of up to ±10% of the stated value, for example, ±10%, ±9%, ±8%, ±7%, ±6%, ±5%, ±4%, ±3%, ±2%, ±1%, ±0.01%, or ±0.0% of the stated value, as well as values intervening such stated values.

It is to be understood that unless specifically stated otherwise, references to "a," "an," and/or "the" may include one or more than one, and that reference to an item in the singular may also include the item in the plural.

The phrase "and/or" should be understood to mean "either or both" of the elements so conjoined, i.e., elements that are conjunctively present in some cases and disjunctively present in other cases. Other elements may optionally be present other than the elements specifically identified by the "and/or" clause, whether related or unrelated to those elements specifically identified unless clearly indicated to the contrary. Thus, as a non-limiting example, a reference to "A and/or B," when used in conjunction with open-ended language such as "comprising" can refer, in one embodiment, to A without B (optionally including elements other than B); in another embodiment, to B without A (optionally including elements other than A); in yet another embodiment, to both A and B (optionally including other elements); etc.

An "operative connection," or a connection by which entities are "operatively connected," is one in which the entities are connected in such a way that the entities may perform as intended. An operative connection may be a direct connection or an indirect connection in which an intermediate entity or entities cooperate or otherwise are part of the connection or are in between the operatively connected entities. An operative connection or coupling may include the entities being integral and unitary with each other.

The word "flexible" as described herein is used with its ordinary and customary meaning as understood by those having ordinary skill in the art, for example the ability to endure repeated bending, flexing, twisting, or bowing without rupture as set forth in accordance with the ASTM Dictionary of Engineering Science and Technology 10th Edition (2005) (referencing ASTM F141, D123, D4850); See also: measurement by shore value according to ASTM D2240, or ASTM 1053 (Stiffness/Flexibility). A non-limiting example of a flexible material is an elastomer, such as silicone rubber.

The word "resilient" as described herein is used with its ordinary and customary meaning as understood by those having ordinary skill in the art, for example a material that will change shape as force is applied and which will return to the same shape, or substantially the same shape, when the force is removed, as set forth in the ASTM Dictionary of Engineering Science and Technology 10th Edition (2005) (referencing ASTM]D123, D1566, D4850); or the ability of a material to absorb energy when it is deformed elastically, and release that energy upon unloading. A non-limiting example of a resilient material is an elastomer, such as silicone rubber.

The word "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," may refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of."

The transitional words or phrases, such as "comprising," "including," "carrying," "having," "containing," "involving," "holding," and the like, are to be understood to be open-ended, i.e., to mean including but not limited to.

While preferred materials for elements have been described, the device is not limited by these materials. Wood, plastics, rubber, foam, metal alloys, aluminum, and other materials (or combinations of any of the foregoing) may comprise some or all of the elements of the candle vessel in various embodiments of the present invention.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A candle vessel comprising:

a first part and a second part that are arranged to form a vessel body having an internal cavity with an upper opening for receiving and containing a meltable wax;

the first part being made with a first material and forming an exterior portion of the vessel body, the exterior portion forming a hollow cylinder that encompasses a longitudinal axis of the vessel body and extends longitudinally from an upper portion of the exterior portion to a lower portion of the exterior portion;

the second part being made with a second material having a greater flexibility than the first material, and the second material being a non-stick material with the meltable wax, wherein the second part is arranged at least partially internally of the first part, the second part having an internal surface that forms a bottom of the internal cavity and forms an upright sidewall portion of the internal cavity at a radially outer periphery of the internal cavity, the upright sidewall portion encompassing the longitudinal axis and tapering radially outwardly in a longitudinally upward direction away from the bottom of the internal cavity, the second part further including an outer portion having an outer surface that forms at least part of an exterior base of the vessel body, the outer surface including a radially inward bottom region underlying the bottom of the internal cavity to form a lower wall between the internal surface of the bottom of the internal cavity and the outer surface of the radially inward bottom region;

wherein the outer portion of the second part extends longitudinally lower than a lowermost edge of the first part, and wherein the radially inward bottom region forms a central bottom portion of the vessel body that is configured to engage against a surface upon which the candle vessel rests; and wherein the lower wall of the second part is configured to flex in response to an engagement force by a user acting thereupon to provide displacement of the meltable wax, or remnants thereof, and the non-stick material and tapering of the of the upright sidewall portion of the second part facilitates removal of the meltable wax or the remnants from the internal cavity through the upper opening.

2. The candle vessel according to claim 1, wherein the upright sidewall portion of the internal surface radially outwardly tapers continuously in the longitudinally upward direction to an upper edge of the second part to form an entirety of the internal cavity that is configured to contain the meltable wax.

3. The candle vessel according to claim 1, wherein the upright sidewall portion includes a stepped surface that is located closer to the bottom of the internal cavity than a top of the internal cavity, wherein the stepped surface provides a wider region of the internal cavity above the stepped surface and a narrower region of the internal cavity below the stepped surface.

4. The candle vessel according to claim 1, wherein the outer portion of the second part includes a radially outwardly protruding lip that underlies a bottom edge of the first part.

5. The candle vessel according to claim 4, wherein second part forms an entirety of the exterior base of the vessel body.

6. The candle vessel according to claim 1, wherein the hollow cylinder formed by the first part is in the form of a tubular shell that surrounds at least a portion of the second part and tapers radially inwardly in a longitudinally downward direction.

7. The candle vessel according to claim 1, wherein the second material is a resilient elastomer, and wherein the first material is a rigid plastic, glass, metal, or ceramic.

8. The candle vessel according to claim 1, wherein the upper portion of the second part forms a top edge of the vessel body.

9. The candle vessel according to claim 1, wherein the exterior portion of the first part tapers radially inwardly in a longitudinally downward direction.

10. The candle vessel according to claim 1, wherein the second material is a resilient elastomer, and wherein the first material is a rigid plastic, glass, metal, or ceramic.

11. A candle comprising:

a candle vessel comprising:

a first part and a second part that are arranged to form a vessel body having an internal cavity with an upper opening for receiving and containing a meltable wax;

the first part being made with a first material and forming an exterior portion of the vessel body, the exterior portion encompassing a longitudinal axis of the vessel body and extending longitudinally from an upper portion of the exterior portion to a lower portion of the exterior portion;

the second part being made with a second material having a greater flexibility than the first material, and the second material being a non-stick material with the meltable wax, wherein the second part is arranged at least partially internally of the first part, the second part having an internal surface that forms a bottom of the internal cavity and forms an upright sidewall portion of the internal cavity at a radially outer periphery of the internal cavity, the upright sidewall portion encompassing the longitudinal axis and tapering radially outwardly in a longitudinally upward direction away from the bottom of the internal cavity;

the second part further having a lower outer surface underlying the bottom of the internal cavity to form a lower wall between the internal surface of the bottom of the internal cavity and the lower outer surface;

a meltable wax including a burnable wick contained within the internal cavity of the vessel body;

wherein the meltable wax, the burnable wick, and the vessel body are respectively configured to melt the meltable wax such that a melt pool is formed that contacts the tapered upright sidewall along a length of the internal cavity without tunneling; and wherein the lower wall of the second part is configured to flex in response to an engagement force by a user acting thereupon to provide displacement of the meltable wax, or remnants thereof, and the non-stick material and tapering of the of the upright sidewall portion of the second part facilitates removal of the meltable wax or the remnants from the internal cavity through the upper opening.

12. The candle according to claim 11, wherein the exterior portion of the first part forms a hollow cylinder that engages a radially outer surface of the second part.

13. The candle according to claim 11, wherein the lower portion of the exterior portion of the first part includes a radially inwardly extending bottom portion that forms a lower rim at a base of the vessel body, with a lower opening extending through the bottom portion; and wherein at least a portion of the lower wall of the second part extends into the lower opening such that the second part is engageable via the lower opening.

14. A candle comprising:

the candle vessel according to claim 1, and a meltable wax including a burnable wick contained within the internal cavity of the vessel body;

wherein the meltable wax, the burnable wick, and vessel body are respectively configured to melt the meltable wax such that a melt pool is formed that contacts the tapered upright sidewall along a length of the internal cavity without tunneling.

15. A method comprising:

(i) having the candle according to claim 11 with the meltable wax or remnants thereof disposed in the internal cavity;

(ii) engaging the lower portion of the candle vessel with an engagement force that causes the lower portion to flex which displaces the meltable wax or the remnants in the cavity; and (iii) removing the meltable wax or the remnants from the internal cavity of the candle vessel.

16. The candle according to claim 14, wherein the wax is a paraffin wax, beeswax, plant-based wax, or soy wax.

17. The candle according to claim 11, wherein the wax is a paraffin wax, beeswax, plant-based wax, or soy wax.

18. The candle vessel according to claim 1, wherein an upper portion of the second part forms a top edge of the vessel body, and wherein the upper portion of the second part includes a radially outward upper lip that overlaps an upper edge of the first part.

19. The candle vessel according to claim 11, wherein the second part forms an entirety of an exterior base of the vessel body.

20. The candle according to claim 19, wherein the second part includes a radially outward lower lip that underlies a bottom edge of the first part.

21. The candle according to claim 20, wherein an upper portion of the second part forms a top edge of the vessel body, and wherein the upper portion of the second part includes a radially outward upper lip that overlaps an upper edge of the first part.

22. The candle vessel according to claim 21, wherein the first part forms a hollow cylinder that tapers radially inwardly in a longitudinally downward direction.

* * * * *